United States Patent [19]

Vangaever

[11] Patent Number: 4,895,476

[45] Date of Patent: Jan. 23, 1990

[54] BRUSHING DEVICE AND METHOD

[75] Inventor: Marc Vangaever, Markegem, Belgium

[73] Assignee: Procedes et Brevets Industriels, en Aberge "P.B.I." S.A., Luxembourg, Luxembourg

[21] Appl. No.: 2,243

[22] Filed: Jan. 12, 1987

[30] Foreign Application Priority Data

Jan. 23, 1986 [BE] Belgium ..... 216130

[51] Int. Cl.[4] ..... E01F 13/00

[52] U.S. Cl. ..... 404/6; 404/108; 15/83

[58] Field of Search ..... 404/101–103, 404/108–110, 113, 128; 15/83; 51/174, 176

[56] References Cited

U.S. PATENT DOCUMENTS

| | | | |
|---|---|---|---|
| 2,189,859 | 2/1940 | Evans | 15/85 |
| 2,238,716 | 5/1941 | Wells | 15/82 |
| 2,248,012 | 7/1941 | Phillips | 15/82 |
| 2,684,496 | 7/1954 | Lull | 15/83 |
| 2,697,846 | 12/1954 | Wilcox et al. | 15/83 |
| 2,708,280 | 5/1955 | Antos et al. | 15/83 |
| 2,709,269 | 5/1955 | Williams | 15/50 |
| 3,178,746 | 4/1965 | Voelstad | 15/83 |
| 3,337,890 | 8/1967 | Schmidt, Jr. | 15/83 |
| 3,354,489 | 11/1967 | Ehrilich | 15/83 |
| 3,444,583 | 5/1969 | Laurel | 15/340 |
| 3,568,232 | 3/1971 | Swanson | 15/83 |
| 3,878,952 | 4/1975 | Hueftle | 414/697 |
| 3,881,215 | 5/1975 | Krier et al. | 15/83 X |
| 4,037,284 | 7/1977 | McDonald | 15/83 |
| 4,042,994 | 8/1977 | Sassaman et al. | 15/83 |
| 4,120,311 | 10/1978 | Dunham et al. | 15/83 X |
| 4,655,635 | 4/1987 | Furukawa | 404/113 X |

FOREIGN PATENT DOCUMENTS

| | | | |
|---|---|---|---|
| 899230 | 7/1984 | Belgium . | |
| 902003 | 7/1985 | Belgium . | |
| 1154497 | 9/1963 | Fed. Rep. of Germany . | |
| 8604626 | 8/1986 | PCT Int'l Appl. | 15/83 |
| 15421035 | 8/1978 | United Kingdom . | |
| 2060034 | 4/1981 | United Kingdom . | |

*Primary Examiner*—Stephen J. Novosad
*Assistant Examiner*—Gay Ann Spahn
*Attorney, Agent, or Firm*—Fleit, Jacobson, Cohn, Price, Holman & Stern

[57] ABSTRACT

Brushing apparatus including a motor vehicle provided with a tool-holder member, a fast-locking member pivoted to the tool-holder member, a container removably mounted on the fast-locking member and having an opening into which material to be collected is brushed during a brushing operation, and from which it is discharged by tilting the container. A power operated, rotatable brush pivotally mounted on the container swingable relative thereto about a horizontal axis under the action of gravity of hydraulic jack. The powered brush is so supported by the container as to lie adjacent to the container opening during brushing and to expose the opening when emptying the container. The brushing implement and container may be pivotally located about a vertical axis to place the brush at an angle to the vehicle movement. The brush is rotatable in either direction to sweep material from a surface or into the container.

19 Claims, 4 Drawing Sheets

BRUSHING DEVICE AND METHOD

BACKGROUND OF THE INVENTION

1. Field of the Invention

This invention relates to brushing apparatus including a motor vehicle provided with a raisable and lowerable tool-holder member and a brushing assembly which is easily demountably attached to the tool-holder and which includes a bucket demountably attached to the tool-holder and at least one powered brush which is mounted on the bucket in such a manner to brush material into or out of the bucket.

The invention further relates to a brushing method, which comprises the steps of arranging a frontward-opening bucket or container near a surface to be brushed and brushing in front of said container with a powered brush, in such a way as to throw the material being brushed-off the ground through the container opening, while supporting the brush and container together on a motor vehicle.

The invention may notably be applied during paving work, brushing operations in streets or over factory floors, etc.

2. Description of the Related Art

Known brushing apparatus and methods, relating to the brief description above are found in Belgian Pat. Nos. 899,230 and 902,003. Those patents describe a tractor vehicle provided with an implement which is used only for brushing a paving surface on which sand has been spread and tamped. That implement, which is not easy to handle, includes a collecting container and a revolving brush which are fixedly arranged relative to one another. Both the brush and container can have but two positions; a brushing position, and a hanging position wherein the container may be emptied. Guiding of the implement during the brushing operation can only occur by pulling. Finally, material particles being brushed upwards or sidewise can not reach the container, and may even soil the tractor vehicle or reach the driver thereof.

There has also been known for some time a movable vehicle which includes a tool-holder to which a toothless bucket may be hooked. By means of a bucket so hooked to the tool-holder as to be swingable relative thereto about a horizontal axis, it is possible to pick up grain-like material, for example sand, from a heap and to spread the sand over the ground by angling the bucket downward and forward in such a way that the front edge of the bucket lies short distance away from the ground, and the bucket contents flow gradually over the ground as the vehicle backs away. It is even possible to use the front bucket edge to try to level a previously-spread sand layer (see also in this respect the above-mentioned Belgian patents). It is not possible, however, to use such vehicles to obtain an absolutely uniform leveling of a thin, grain-like material layer over a ground surface, and because the apparatus being used is quite powerful, there may be a danger in using same, for example, to drive sand between paving-stones which have just been laid. Finally, it is known by means of the front edge of such a bucket, to scrape the ground before brushing same, such an operation being unavoidable when mud or moist sand covers that area to be cleaned.

SUMMARY OF THE INVENTION

This invention has for an object to provide brushing apparatus and methods for brushing that enables not only brushing of a surface and emptying of a collecting container, but also, filling of the container with grain-like material from a grain-like material heap, and spreading of the material uniformly over the ground, as well as depositing of the material between paving-stones which have just been laid, while avoiding simultaneously the above-mentioned drawbacks. The invention further enables scraping of the ground together with brushing same.

The above-mentioned problems have been solved, according to the invention, by making use of apparatus as generally described at the start, comprising a container or bucket easily demountably connected to a tool-holder member carried by a motor vehicle. The tool-holder member is swingable about a horizontal axis under the action of a swinging means, such as hydraulic piston and cylinder combinations, controlled from the motor vehicle. A powered brush or brushes are so supported by the container as to be movable relative thereto to lie adjacent to the container opening or bucket mouth in the brushing position and to expose the opening in the container-emptying position.

In general, the powered brush or brushes are mounted swingable or pivotal relative to the container about a horizontal swing axis. In a particular embodiment of the invention, the powered brush or brushes are freely swingable or pivotal relative to the container, with the center of gravity of the brush and associated parts so located that the brush lies automatically in a swung-down position in the direction of and in proximity to the container opening when brushing, and in a position away from and remote from the opening when emptying the container.

In an advantageous embodiment of the invention, the container is a bucket having two side walls, a back wall and a bottom wall, and the powered brush is a revolving brush which is rotatable about a horizontal revolution axis by a rotating means controlled from the motor vehicle.

There is further provided, according to the invention, a brushing method which involves angling the container downwards and frontwards in such a way that only the front container edge lies adjacent to the ground, and the grain-like material contained in the container flows gradually to the ground along the front edge, gradually backing-away the motor vehicle and attached container and the powered brush, and leveling with the powered brush rotating in a preselected direction, that grain-like material, such as sand, deposited from and spread over the ground by the container.

There is also provided, according to the invention, a brushing method which involves simultaneous scraping and brushing the ground by setting the front container edge on the ground to be scraped and brushed and moving the container forward while brushing.

Other details and features of the invention will be apparent from the following description, given by way of a non-limitative example, and with reference to the accompanying drawings.

DESCRIPTION OF THE PREFERRED EMBODIMENTS

Figure 1:
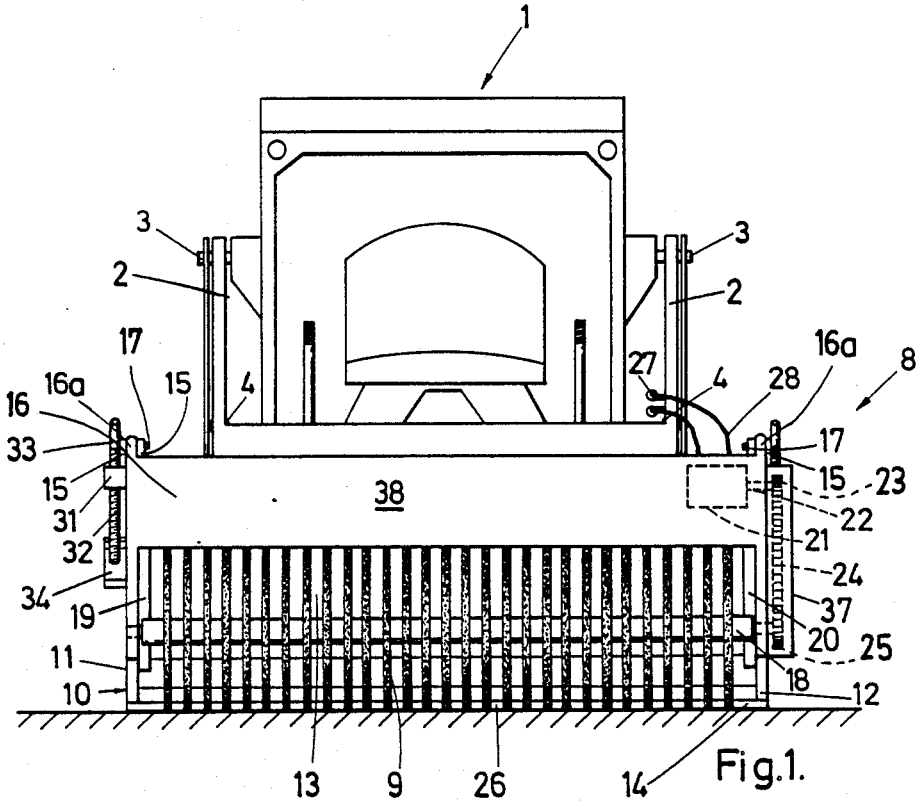
FIG. 1 shows a front view of brushing apparatus, according to the invention, in brushing position.

In the various figures, the same reference numerals show identical or similar elements.

Figure 2:
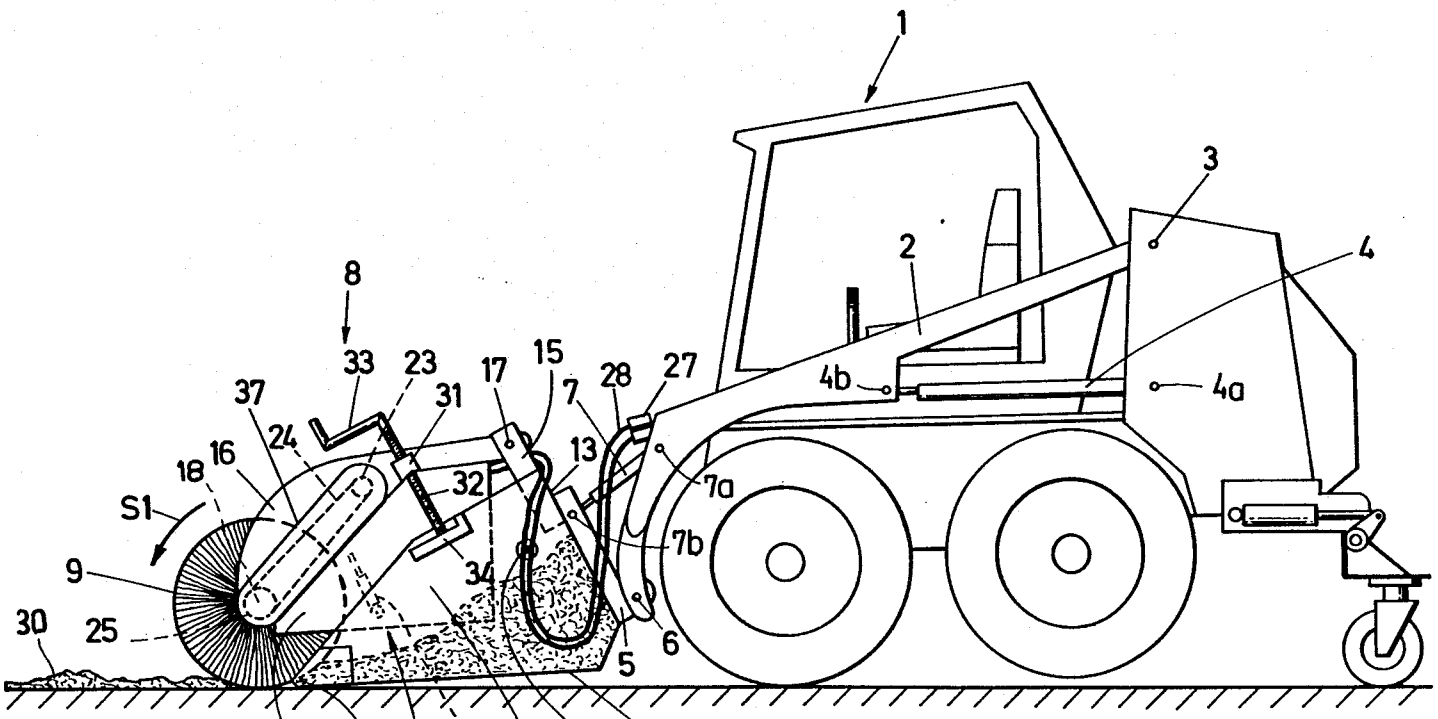
FIG. 2 shows a side view of the apparatus shown in FIG. 1.

The brushing apparatus according to the invention, in the preferred embodiment as shown in FIGS. 1 and 2 of the drawings, includes a conventional motor vehicle 1, in the form of a hydraulic loader, which is provided with a tool-holder comprised of two bent arms 2 which are each connected by conventional means at one end thereof to the back of motor vehicle 1, to be swingable relative thereto about axes 3. A pair of hydraulic jacks 4 are hinged at one end (cylinder end) to motor vehicle 1 at pivots 4*a*, and at their other ends (piston rod end) approximately midway on arms 2 at pivots 4*b*, to enable raising and lowering of arms 2 by a command from vehicle 1 issued by the operator of the motor vehicle 1.

Between the free ends of arms 2, which lie forward of vehicle 1 and face downwardly in the low position, a hinge is provided for mounting an easily detachable, fast-locking member 5. The bottom of the locking member 5 is hinged in a conventional way between arms 2 such that locking member 5 is pivotal or swingable about a horizontal axis 6 relative to the tool-holder member 2. A pair of hydraulic jacks 7 are also hingedly connected at hinge points 7*a* (cylinder end), 7*b* (piston end) located on the bend in each arm 2, and on the top end of the fast-locking member 5, respectively. The hydraulic jacks 7 are controlled from motor vehicle 1 in a conventional way, and enable limited swinging of the locking member 5 while firmly retaining same in any intermediate position between the extremes of its pivotal movement.

In the embodiment as shown, the brushing apparatus according to the invention further comprises a powered brushing assembly shown generally as reference number 8. The brushing assembly includes a power operated brush 9 and a container or bucket 10 in the form of a toothless bucket for collecting the brushed material. The bucket comprises two side walls 11, 12, a back wall 13 and a bottom wall 14, and open at its front. According to the invention, the brushing assembly 8 is connected to the tool-holder arms 2 through bucket 10, and assembly 8 is swingable or pivotal relative thereto about the horizontal axis 6 under the action of jacks 7 controlled from the motor vehicle. In the embodiment as shown, the bucket 10 is easily disconnectably or demountably connected by conventional means to the fast-locking member 5 and is rotatable about axis 6 which lies approximately at the bottom of the back wall 13 of bucket 10. The easily-disconnectable connection between bucket 10 and the fast-locking member 5 may be any known connection such as hooks and pins, and is readily known to those skilled in the art. Therefore, no further detailed description is provided.

According to the invention, the brushing assembly 8 includes a rotatable brush 9 supported by bucket 10 to be freely swingable or pivotal relative thereto about a horizontal axis. In the embodiment shown, the bucket 10 is provided along each upper back corner thereof with a fitting 15 which projects above the upper edge of back wall 13 of the bucket. Supporting arms 16 for mounting the brush 9 are carried at one of their ends 16*a* by being fixed to horizontal, axially aligned shafts 17 which are pivotally carried in the fittings 15. Arms 16 are in planar alignment with side plates 11 and 12 of bucket 10. The supporting arms 16 in the lower position of bucket 10 extend above the bucket and carry between them, at their lower ends, the trunnions of a horizontal rotation shaft 18 on which brush 9 is fixed. Shaft 18 can be rotated in a controlled way from the motor vehicle, and, in turn, rotates brush 9 fixed on it.

In the embodiment as shown, the brush supporting arms 16 are joined together by or are formed integral with an upper brush cover or hood 38 that extends above the bucket 10. Arms 16 also extend downwardly and are connected or joined to brush side plates or cheeks 19 and 20 that are laterally offset inwardly, that is, located in slightly inwardly-staggered planes relative to the planes of arms 16 so that the side plates 19 and 20 may enter into the bucket adjacent bucket side walls 11 and 12 and be received in the mouth of the bucket. The support arms 16, brush cover 38 and brush side plates or cheeks 19 and 20 define a closure or hood which prevents brushed material from projecting upwardly or sidewise out of the bucket 10.

The means for revolving brush 9 is comprised, as shown diagrammatically in FIG. 1 of a conventional hydraulic motor 21 capable of driving in both directions shieldingly secured under brush cover 38 adjacent one side. An output shaft 22 of motor 21 extends through the adjacent support arm 16 (adjacent side wall 12) and rotates a gear pinion 23 which, in turn, rotates a chain 24 that drives a gear pinion 25 secured to an end of one trunnion of revolving shaft 18 which also extends through arm 16, to rotate brush 9. The power transmission components for rotating the brush 9 are housed underneath a suitable cover 37, that is advantageously mounted to be easily removable from supporting arm 16. The hydraulic motor 21 is connected to an auxiliary hydraulic connector 27 supported by the tool-holder arms 2 on the same side as side wall 12 through hydraulic hoses 28. The hoses 28 are held, for the sake of safety, against side wall 12 of bucket 10, by any suitable means, for example, a clip fastener 29 including a permanent magnet for adhering to side wall 12.

Finally, the outer sides of brush support arms 16, intermediate their ends are provided with outwardly extending tapped bosses 31 through which screw-threaded rods 32 having hand cranks 33 attached are rotatably received It is possible to adjust the brush stop position, relative to bucket 10, by screwing rods 32 relative to tapped bosses 31 and thus limit the downward swinging movement of the brush 9, because the free ends of screw-threaded rods 32 engage stops 34 that are secured to and extend outwardly from the side walls 11 and 12 of bucket 10.

Figure 6:
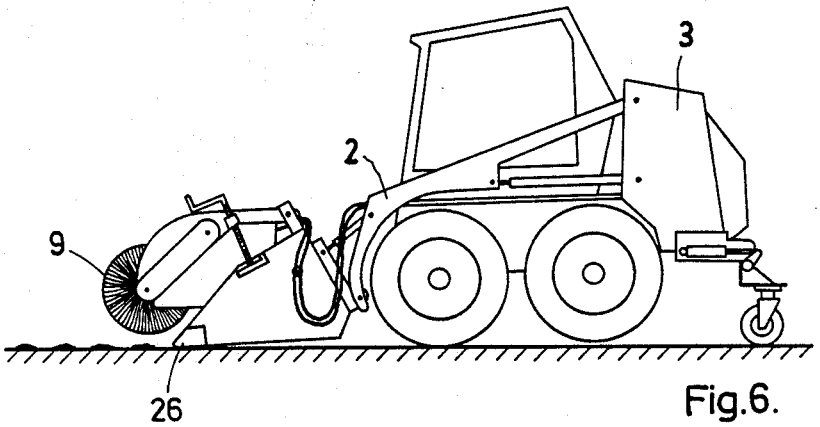
FIG. 6 shows, also on a smaller scale, a side view of the same apparatus in the position for scraping the ground, without simultaneously brushing.

In the brushing position, as shown in FIGS. 1 and 2, the tool-holder arms 2 lie in their down or low position, relative to vehicle 1, and bottom wall 14 of bucket 10 is located nearly flat on the ground, by extending or withdrawing the rods from jacks 7 a suitable distance. The bucket swing axis 6 lies substantially at the bottom of back wall 13 of the bucket 10 and the axially aligned swing shafts 17 of the brush 9 lie above the back wall 13 of bucket 10 substantially in the extension of the plane thereof, and the support arms 16 extend frontwards and downwards. In this position, the center of gravity of brush 9 and associated components that serve to support and rotate brush 9, that is arms 16, hood 38 and side plates 19 and 20, as well as motor 21 and transmission means 22 to 25 and 18, are so located that the brush undergoes a downward force, caused by gravity, tending to swing the brush 9 about the axis defined by axially aligned shafts 17 in a counter-clockwise direction as viewed in FIG. 2, that is, in the direction both of the ground and the front edge 26 of bucket 10. Thus, in the brushing position, the brush 9, driven by motor 21, is automatically swung-down in the direction of the bucket opening, by being rotated in the direction as shown by arrow S1 in FIG. 2. The brush 9 is driven in the direction of arrow S1 and thus throws grain-like material or dirt, denoted by reference number 30, lying on the ground into the opening of bucket 10, which fills progressively as vehicle 1 moves forward. Moreover, in such a position the front bucket edge 26 may, as shown in FIG. 2, be pressed against the ground, and in such a case it scrapes, together with the brushing operation, mud or moist sand lying on the ground, for example the mud deposited on the ground by truck tires. Such a scraping operation simultaneous with the brushing operation, can not be obtained by means of conventional brushes. For such a scraping operation, the front edge 26 of bucket 10 is preferably made of anti-wear steel when scraping concrete or asphalt, and is advantageously provided with a lip of nylon, or a similar material, when scraping a structured paving stone surface, to avoid damaging the paving-stones. The height adjustment of the brush relative to the ground during a scraping operation may, however, be adjusted by the above-defined length adjustment of the screw-threaded rods 32 by means of the crank-handles 33. Thus, as shown in FIG. 6, the brush 9 in the swung-down position can be adjusted so that it does not engage the ground, and it is, therefore, possible to perform a scraping operation without simultaneously brushing.

Figure 5:
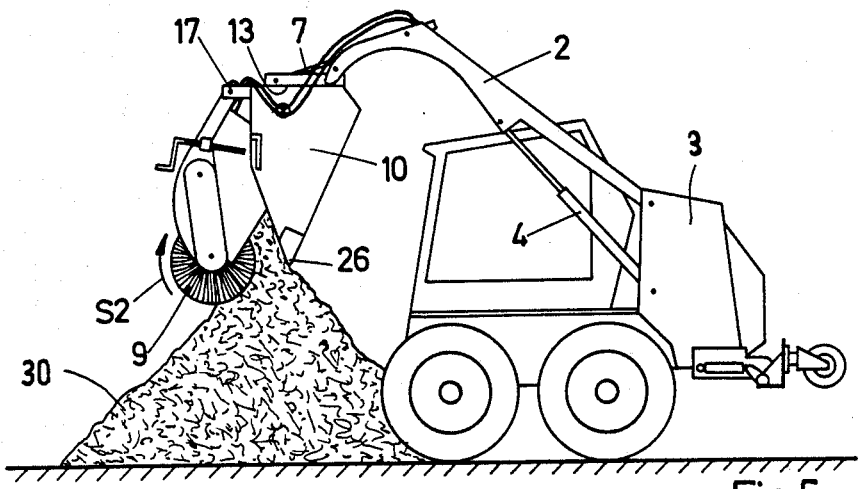
FIG. 5 shows, also on a smaller scale, a side view of the same apparatus, in the position for emptying the container.

After filling, the bucket 10 can be lifted by raising the arms 2 by extending or withdrawing the rods of jacks 4. Then, as shown in FIG. 5, the rods of jacks 7 may be extended or withdrawn to tilt the bucket 10 downwardly and to pivot the back wall 13 of bucket 10 to an approximately horizontal position, with the axially aligned swing shafts 17 of brushing implement 8 then lying in front of the bucket 10, that is, in a vertical plane forward of bucket 10. In this position, the center of gravity of brush 9 and associated components that serve to support and rotate the brush 9 are so located that the brush undergoes a force due to gravity which swings the brush 9 slightly clockwise as viewed in FIG. 5, about the shafts 17. That is, the brush 9 is moved slightly away from and forward relative to the front edge 26 of bucket 10. The brush 9 then automatically exposes the bucket opening, which then faces or opens downwardly, and thus, allows discharging of the bucket contents. By driving or revolving brush 9 in the direction shown by arrow S2 of FIG. 5, which direction is opposite to the brushing direction S1, the brush 9 serves at the same time as an auxiliary and positive discharge means for bucket 10.

Figure 3:
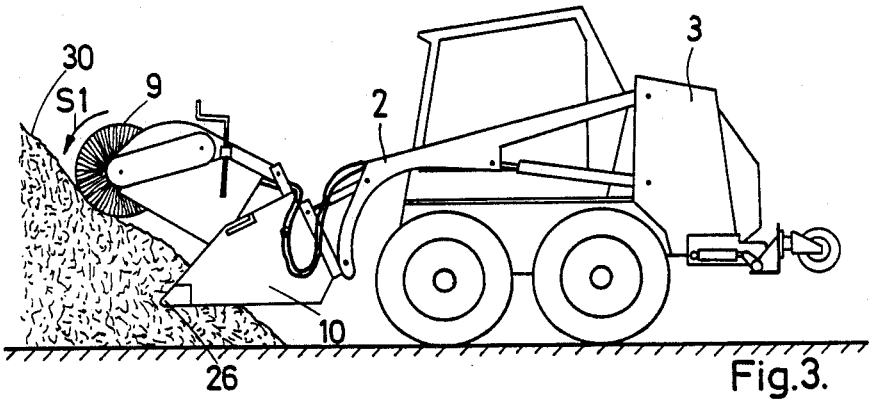
FIG. 3 shows, on a smaller scale, a side view of the same apparatus, in the position for filling the container with grain-like material from a heap.

As seen in FIG. 3, the brushing device according to the invention may simultaneously serve as means for moving a grain-like material, such as sand or grit, from a heap, into bucket 10 for conveyance to a given or desired location. Bucket 10 is driven by motor vehicle 1 in the usual way into the sand heap 30, and is then raised by arms 2 with the sand that is picked up by bucket 10. This operation is in no way hampered by the presence of brush 9 in front of the opening of bucket 10; to the contrary, in a surprising way, the brush 9 makes the operation easier and serves as an auxiliary means for ensuring the filling of the bucket 10. Indeed, at that moment when the front bucket edge 26 engages the slope of the sand heap 30, the brush 9 undergoes the action of the force of gravity as during the brushing, that is, brush 9 swings down toward front edge 26. However, it first engages the slope of heap 30, and, as it is rotated in the direction shown by arrow S1 in FIG. 3, the rotation results, on the one hand, in causing the brush 9 to climb up the slope and thus to open the bucket, and, on the other hand, to move or throw during brushing the sand lying on the slope of the heap 30 into the bucket opening.

Figure 4:
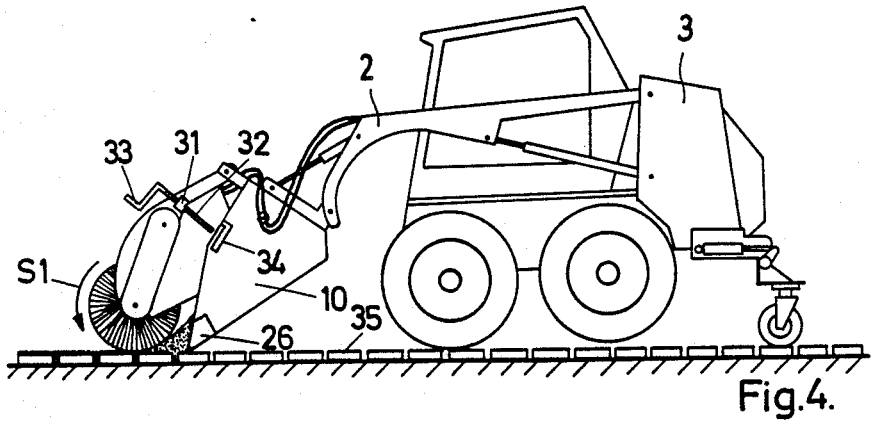
FIG. 4 shows, on a smaller scale, a side view of the same apparatus, in the position for spreading grain-like material over a ground surface formed by just-laid paving-stones.

As seen in FIG. 4, it is possible to spread sand from the bucket over the ground by backing the motor vehicle 1 away and by angling the bucket 10 downwards and frontwards with the front edge 26 thereof adjacent to the ground. By means of the apparatus according to the invention, it is then possible to level directly, with a uniform thickness, the sand flowing out of the bucket, by revolving the brush 9 in the direction shown by arrow S1 of FIG. 4. The brush is swung down to the ground by gravity under the weight thereof, and brushes or throws the excess sand toward and into the bucket 10. It is also possible to regulate the sand layer thickness desired by suitably adjusting the adjustable stop means 31–34 as described above. As shown in FIG. 4, sand is spread over the ground 35 defined by a plurality of just-laid paving-stones. Besides the sand leveling action described, the brush 9 forces the sand into the cracks between the paving-stones.

The handy apparatus according to the invention thus enables advantageously brushing a given ground surface and discharging quickly and easily the bucket contents on a heap or inside a truck skip, the brush even contributing positively to emptying the bucket. The invention also enables spreading uniformly a grain-like material such as sand over the ground, in a single operation, and possibly also driving sand between paving-stones. The same brushing apparatus thus allows two or even three different paving operations, which up to now were performed by two different apparatuses, that is, one for spreading sand on the ground before laying paving-stones and spreading sand over the laid paving-stones, and one for brushing the paving so formed after the passage of a roller or a vibrating tamping plate. By raising the bucket 10 by means of the tool-holder arms 2, it is possible to easily discharge the contents thereof onto an existing heap or inside a truck, as well to as to pick up sand or grit from a heap. The brush 9 serves as an auxiliary means for each of the operations, and does not hamper such operations in any way. The apparatus according to the invention also enables, at will, scraping the ground together with brushing, or independently from such brushing, or else brushing without scraping.

In a modification of the invention the brush 9 is moved relative to the bucket 10, not under the action of gravity, but under the action of a brush moving force that originates from the motor vehicle 1.

Also, in another modification of the invention, one or a plurality of revolving brushes can be positioned in front of bucket 10 with a vertical or slanting revolution axis, so that it or they can be moved away from the bucket opening by swinging or pivoting about a vertical axis.

In another modification of the invention the brushing height can be adjusted, for example, arranging a series of spaced stops on the brush-supporting structure.

Figure 7:
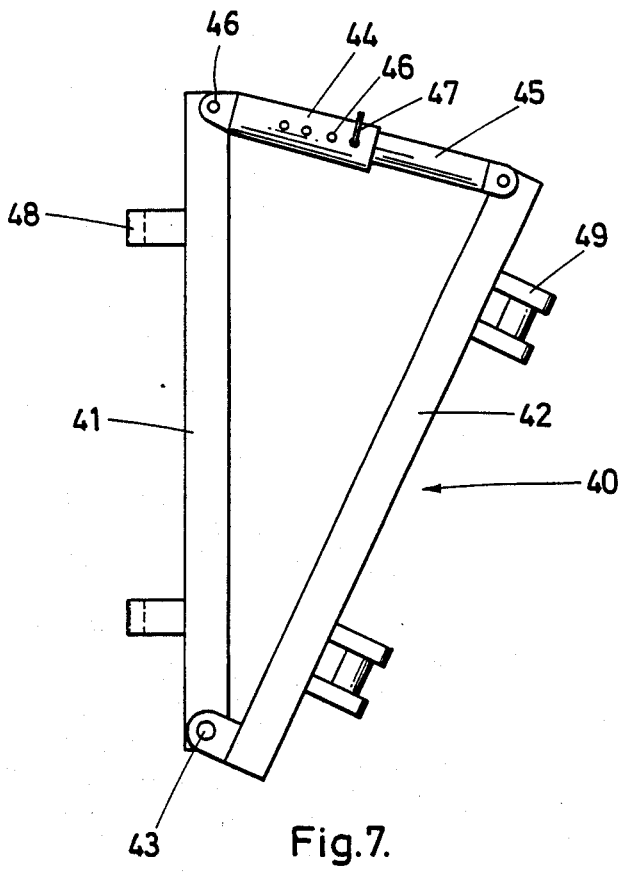
FIG. 7 shows a top view of an intermediate part to secure the container and brush at an angle relative to the motor vehicle.

FIG. 7 shows an arrangement for securing bucket 10 to fast-locking member 5 when it is desired to pivot the axis of rotation of brush 9 in a horizontal plane and about a vertical axis in order to use the brushing apparatus according to the invention as a snow-plow or for like purposes. An intermediate part 40 accomplishes the foregoing and consists of a first arm 41 having hooks 48 mounted on one edge in spaced relation that can coact with like spaced pins mounted on fast-locking member 5, and a second arm 42, which has mounted on one edge spaced axially aligned pins 49 similar to the pins mounted on locking member 5, for coaction with hooks on the bucket 10 similar to hooks 48 on first arm 41. Both arms 41, 42 of intermediate part 40 are pivotally joined together at one end, on one side of vehicle 1, by a hinge including pivot pin 43. The other ends of arms 41, 42 are interconnected by adjustable telescopic arms 44 and 45. Arm 44 is hinged by pivot pi 46 to the other end of arm 41, arm 45 is hinged to the other end of arm 42, and arm 45 is telescopically received in arm 44. Arms 44 define a series of aligned holes 46 and arm 45 has a hole (not shown) which can be registered with any one of holes 46. A pin 47 is inserted into the registered holes to fix the angular position of arms 41 and 42. In the retracted position of telescopic arms 44, 45, as shown in FIG. 7, arm 42 bears a predetermined angular position relative to arm 41, and both bucket 10 and brush 9 are displaced about a vertical axis defined by the axis of pin 43 relative to the motor vehicle 1 movement. The brush 9 and bucket 10 are thus directed at an angle relative to the vehicle longitudinal axis, and the brush 9, when driven in revolution direction S2 as shown in FIG. 5, will throw snow, for example, in a sidewise direction.

It will be understood that the invention as described is not limited to the specific embodiments, but changes and modifications may be made without departing from the scope of the invention as defined in the appended claims.

What is claimed is:

1. Brushing apparatus comprising: a motor vehicle; a tool-holder means carried by the motor vehicle; means for raising and lowering the tool-holder means relative to the motor vehicle; an assembly removably mounted on the tool-holder means and including container means pivotally mounted relative to the tool-holder means about a first horizontal axis and having an opening into which material to be brushed is deposited during a brushing operation and through which material within the container means is discharged when emptying the container means, brush means rotatable about a second horizontal axis, support means mounting the brush means on said container means for free swinging movement relative to the container about a third axis, and drive means for rotating the brush means; container operator means controlled from and carried by the motor vehicle for pivoting the container means about the first horizontal axis between a brushing position and a container-emptying position; said brush means having a center of gravity relative to the third axis such that the brush means lies adjacent to the container opening in the brushing position of the container means, and is spaced from the container opening to expose the opening in the container-emptying position.

2. Brushing apparatus as claimed in claim 1, wherein the drive means is controlled from the motor vehicle.

3. Brushing apparatus as claimed in claim 1, in which the container means includes a bucket having a front opening, two side walls, a back wall and a bottom wall.

4. Brushing apparatus as claimed in claim 3, wherein in the brushing position the bucket bottom wall lies substantially flat on the ground, the first horizontal axis is located substantially at the bottom of the back wall of the bucket, and the third horizontal axis lies substantially at the top of the back wall of the bucket, and the brush means includes a brush and supporting means therefor that extends over the bucket opening and supporting the second horizontal axis and is mounted to pivot under the action of gravity about the third horizontal axis so that the brush is located directly in front of the front edge of the bucket bottom wall.

5. Brushing apparatus as claimed in claim 4, wherein in the bucket-emptying position the bucket back wall lies substantially horizontally, the third horizontal axis lies in front of the bucket, and the brushing means center of gravity causes the brush to move slightly away and forward relative to the front edge of the bucket bottom wall.

6. Brushing apparatus as claimed in claim 4, which further includes adjusting means carried by the assembly for adjusting the height of the brush relative to the ground.

7. Brushing apparatus as claimed in claim 6, in which the adjusting means includes stop means carried by one of the bucket and the supporting means, and adjustable length engaging means carried by the other of the bucket and the supporting means for engaging the stop means as said supporting means is swung-down toward the bucket under the action of gravity.

8. Brushing apparatus as claimed in claim 4, wherein the supporting means defines a hood which prevents brushed material from being projected upwards or sidewise out of the bucket in a brushing position.

9. Brushing apparatus as claimed in claim 4, wherein the drive means is carried by the supporting means and is controllable from the motor vehicle to rotate the brush in both directions.

10. Brushing apparatus as claimed in claim 3, wherein in the bucket emptying position, the brush is driven in an opposite direction to the brushing direction.

11. Brushing apparatus as claimed in claim 1, wherein the container operator means allows a limited movement of the container means about the first axis, and can stop the container means in any intermediate position between end positions thereof.

12. Brushing apparatus as claimed in claim 11, wherein the container means includes a member mounted on the tool-holder means and a container releasably connected to the member with the member defining the first axis with the tool-holder means and the container operator means interconnects the member and the tool-holder means to pivot the member about the first axis.

13. Brushing apparatus as claimed in claim 11, wherein the container means includes a bucket for picking up grain-like material from a heap and for spreading the picked up material over a given surface.

14. Brushing apparatus as claimed in claim 13, wherein in a position for picking-up grain-like material from a heap, the brush means is rotatable in the direction as for a brushing operation, whereby the brush means can climb up the heap, move away from and open the bucket opening and provide auxiliary means for filling the bucket.

15. Brushing apparatus as claimed in claim 13, in which in the position for spreading the grain-like material over the ground, the bottom of the container means lies at an angle to the ground with the front edge thereof substantially against the ground, and the brush means is rotated in the same rotation direction as for brushing and is swung-down by gravity toward the front edge of the container means and thus, against the ground, to serve as means for leveling over the ground that material spread from the container means.

16. Brushing apparatus as claimed in claim 17, in which for paving operations, the brush means serves for driving the grain-like material between laid paving-stones.

17. Brushing apparatus as claimed in claim 1 wherein the container means has a bottom wall with a forward edge defining a lower edge of said opening and wherein the drive means is adapted for rotating the brush means in a first direction for brushing material into the container means between a lower portion of the brush means and said forward edge.

18. Brushing apparatus as claimed in claim 17 wherein the drive means is further adapted for rotating the brush means in a second direction opposite the first direction to assist in emptying the container means in said emptying position.

19. Brushing apparatus as defined in claim 1 including adjustment means connected between the brush means and the container means for selectively adjusting a spacing defined between the brush means and the container means in said brushing position.

* * * * *